US006517596B2

(12) United States Patent
Dodson et al.

(10) Patent No.: US 6,517,596 B2
(45) Date of Patent: Feb. 11, 2003

(54) WET PICKUP ATTACHMENT FOR VACUUM CLEANERS

(75) Inventors: Diane L. Dodson, Northfield, OH (US); William G. Badley, Pocahontas, AR (US); Chris Konstantacos, San Antonio, TX (US)

(73) Assignee: The Scott Fetzer Company, Westlake, OH (US)

( * ) Notice: Subject to any disclaimer, the term of this patent is extended or adjusted under 35 U.S.C. 154(b) by 0 days.

(21) Appl. No.: 09/972,399

(22) Filed: Oct. 5, 2001

(65) Prior Publication Data

US 2002/0010976 A1 Jan. 31, 2002

Related U.S. Application Data

(62) Division of application No. 09/593,896, filed on Jun. 14, 2000, now Pat. No. 6,324,723.

(51) Int. Cl.[7] ..... B01D 35/157

(52) U.S. Cl. ..... 55/417; 55/462; 96/406

(58) Field of Search ..... 96/405, 406; 55/417, 55/462, DIG. 3; 15/353

(56) References Cited

U.S. PATENT DOCUMENTS

| | | | | |
|---|---|---|---|---|
| 1,444,384 A | * | 2/1923 | Patitz | 55/385.3 |
| 2,528,375 A | | 10/1950 | Lilly | |
| 2,617,138 A | | 11/1952 | Brown, Sr. et al. | |
| 2,726,732 A | | 12/1955 | Faust et al. | |
| 2,744,534 A | | 5/1956 | Faust et al. | |
| 2,867,231 A | | 1/1959 | Gerstmann | |
| 2,887,178 A | * | 5/1959 | Larsson et al. | 96/405 |
| 3,267,511 A | | 8/1966 | Meyerhoefer | |
| 3,290,865 A | | 12/1966 | Serou et al. | |
| 3,909,219 A | | 9/1975 | Fromknecht | |
| 4,041,569 A | | 8/1977 | Petersen | |
| 4,055,405 A | | 10/1977 | Thun-Hohenstein | |
| 4,080,104 A | | 3/1978 | Brown, Jr. | |
| 4,179,769 A | | 12/1979 | Lindquist | |
| 4,246,676 A | | 1/1981 | Hallsworth et al. | |
| 4,341,540 A | | 7/1982 | Howerin | |
| 4,675,936 A | | 6/1987 | Rawlins | |
| 4,723,337 A | | 2/1988 | Ellison et al. | |
| 4,776,060 A | | 10/1988 | Chang | |
| 4,800,615 A | | 1/1989 | Ostroski et al. | |
| 4,809,396 A | | 3/1989 | Houser | |
| 4,821,367 A | | 4/1989 | McAllister et al. | |
| 4,864,680 A | | 9/1989 | Blase et al. | |
| 4,934,021 A | | 6/1990 | Lenting | |
| 5,105,504 A | | 4/1992 | Brzoska | |
| 5,182,834 A | | 2/1993 | Wright et al. | |
| 5,259,871 A | | 11/1993 | Tigerholm | |
| 5,263,224 A | | 11/1993 | Lovelady | |
| 5,377,383 A | | 1/1995 | Christensen | |
| 5,507,068 A | | 4/1996 | Fan et al. | |
| 5,623,744 A | | 4/1997 | Triplett et al. | |
| 5,820,657 A | | 10/1998 | Driker et al. | |
| 5,946,767 A | | 9/1999 | Sinz | |
| 5,946,768 A | | 9/1999 | Kelly | |
| 5,958,113 A | | 9/1999 | Collins et al. | |
| 5,974,624 A | | 11/1999 | Eisen | |
| 6,003,197 A | | 12/1999 | Collen | |
| 6,081,962 A | | 7/2000 | Kasen et al. | |

* cited by examiner

*Primary Examiner*—Robert A. Hopkins
(74) *Attorney, Agent, or Firm*—Jones, Day, Reavis & Pogue

(57) ABSTRACT

A wet pickup attachment for vacuum cleaners has a pair of independent float operated valves to close primary and secondary exhaust openings responsive to different water levels in a collection tank and thereby prevent aspiration of water into a vacuum cleaner that powers the attachment.

4 Claims, 6 Drawing Sheets

WET PICKUP ATTACHMENT FOR VACUUM CLEANERS

RELATED APPLICATIONS

This application is a division of U.S. Ser. No. 09/593,896 filed Jun. 14, 2000, now U.S. Pat. No. 6,324,723.

BACKGROUND OF THE INVENTION

This applications relates to the art of vacuum cleaners and, more particularly, to vacuum cleaners that are capable of picking up liquid and separating same from an air stream that carries the liquid. The invention is particularly applicable to a wet pickup attachment for vacuum cleaners and will be described with specific reference thereto. However, it will be appreciated that the invention has broader aspects and that features of the invention may be used in other wet pickup devices as well as in air/liquid separators that are used for other purposes.

Wet pickup attachments for vacuum cleaners usually have a float operated valve that closes in response to a predetermined liquid level in a collection tank for preventing aspiration of liquid into the vacuum cleaner. Any malfunction of the float operated valve may cause liquid to be aspirated into the vacuum cleaner and cause damage. Therefore, it would be desirable to have a backup arrangement for blocking the flow of moisture laden air into the vacuum cleaner in the event of a malfunction in the float operated valve.

SUMMARY OF THE INVENTION

A wet pickup vacuum cleaner attachment in accordance with the present application includes an air/liquid separator having a collection tank and an exhaust passage. The exhaust passage has normally open primary and secondary exhaust openings that are closable by primary and secondary float operated valves in response to the liquid level in the collection tank.

In the event the primary float operated valve fails to close the primary exhaust opening in response to a predetermined liquid level in the collection tank, the accumulation of additional liquid in the tank will operate the secondary float operated valve to close the secondary exhaust opening.

In accordance with one arrangement, a hollow guide sleeve within the separator chamber has the primary float operated valve slidably guided internally thereof and the secondary float operated valve slidably guided externally thereof.

The primary float operated valve is operable to close the primary exhaust opening in response to a first liquid level in the collection tank, and the secondary float operated valve is operable to close the secondary exhaust opening in response to a second liquid level in the collection tank that is greater than the first liquid level. The primary and secondary exhaust openings are in series so that closing of one opening stops movement of air through both openings.

In one arrangement, the secondary float operated valve includes a valve member having a plurality of downwardly open float tubes depending therefrom. In accordance with another aspect of the application, the primary float operated valve includes a primary float having a plurality of holes therethrough for receiving the float tubes on the secondary float operated valve. The clearance between the holes and float tubes is sufficient to provide relative movement between the primary and secondary floats.

In accordance with another aspect of the application, a valve support member for the float operated valves includes a central guide sleeve, and inner and outer annular walls surrounding the guide sleeve. The inner periphery of the outer annular wall and the outer periphery of the inner annular wall are vertically spaced from one another to provide an outwardly facing annular outlet opening through which air flows outwardly from the separation chamber. A shield member positioned between the valve support member and the primary exhaust opening deflects the air flow in an opposite direction back toward the primary exhaust opening.

It is a principal object of the present invention to provide an improved air/liquid separator having two independent float operated valves.

It is another object of the invention to provide an improved wet pickup attachment for vacuum cleaners.

It is another object of the invention to provide an air/liquid separator having a float operated valve that includes a valve member having a plurality of spaced-apart downwardly open float tubes depending therefrom.

It is also an object of the invention to provide an air/liquid separator with a valve support member having an outwardly facing annular outlet opening therein between inner and outer annular walls.

It is an additional object of the invention to provide an air/liquid separator wherein a hollow guide sleeve has a primary float operated valve slidably guided internally thereof and a secondary float operated valve slidably guided externally thereof.

DESCRIPTION OF A PREFERRED EMBODIMENT

Figure 1:
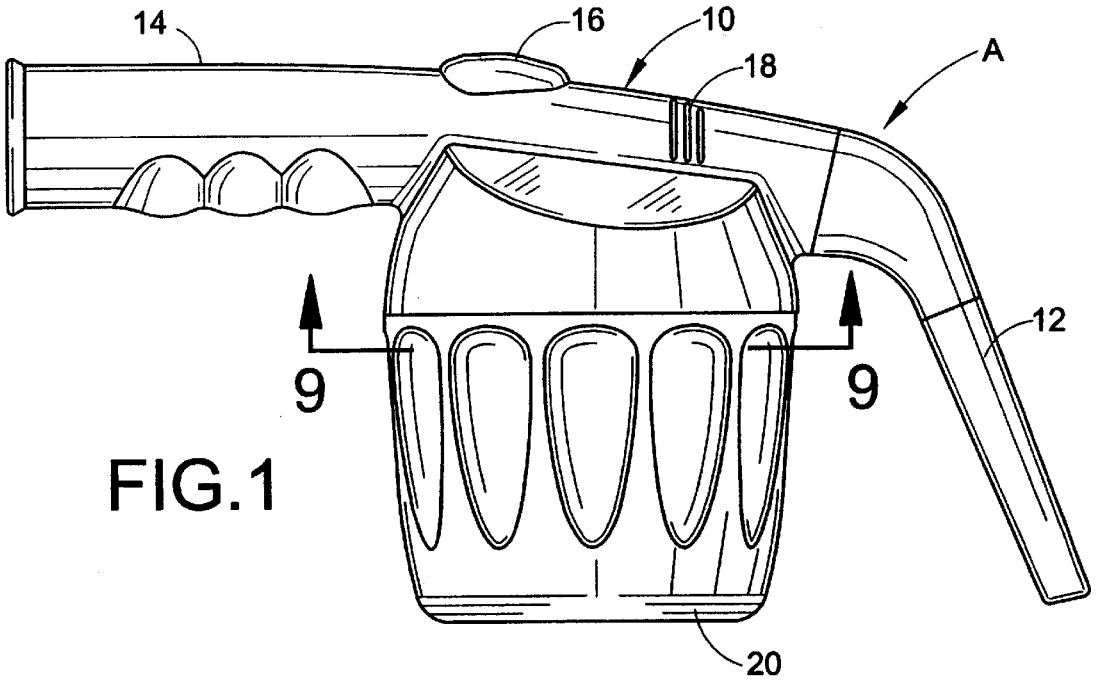
FIG. 1 is a side elevational view of a wet pickup attachment for vacuum cleaners constructed in accordance with the present application.

Referring now to the drawing, wherein the showings are for purposes of illustrating a preferred embodiment of the invention only and not for purposes of limiting same, FIG. 1 shows a wet pickup vacuum cleaner attachment A in accordance with the present application.

Attachment A includes a housing member 10 having an air intake nozzle 12 projecting outwardly and downwardly therefrom. A tubular handle 14 extends outwardly from housing member 10 opposite from nozzle 12.

A manually operable slide button 16 on housing member 10 adjacent handle 14 is movable forwardly for turning the attachment on and is movable rearwardly for turning the attachment off. A plurality of air bleed slots 18 in housing member 10 provide air flow through tubular handle 14 when button 16 is in its rearward off position blocking air flow through air inlet nozzle 12.

A collection tank 20 is removably threaded to housing member 10 for emptying liquid therefrom and to permit cleaning of the interior of the air/liquid separation chamber in attachment A.

Figure 2:
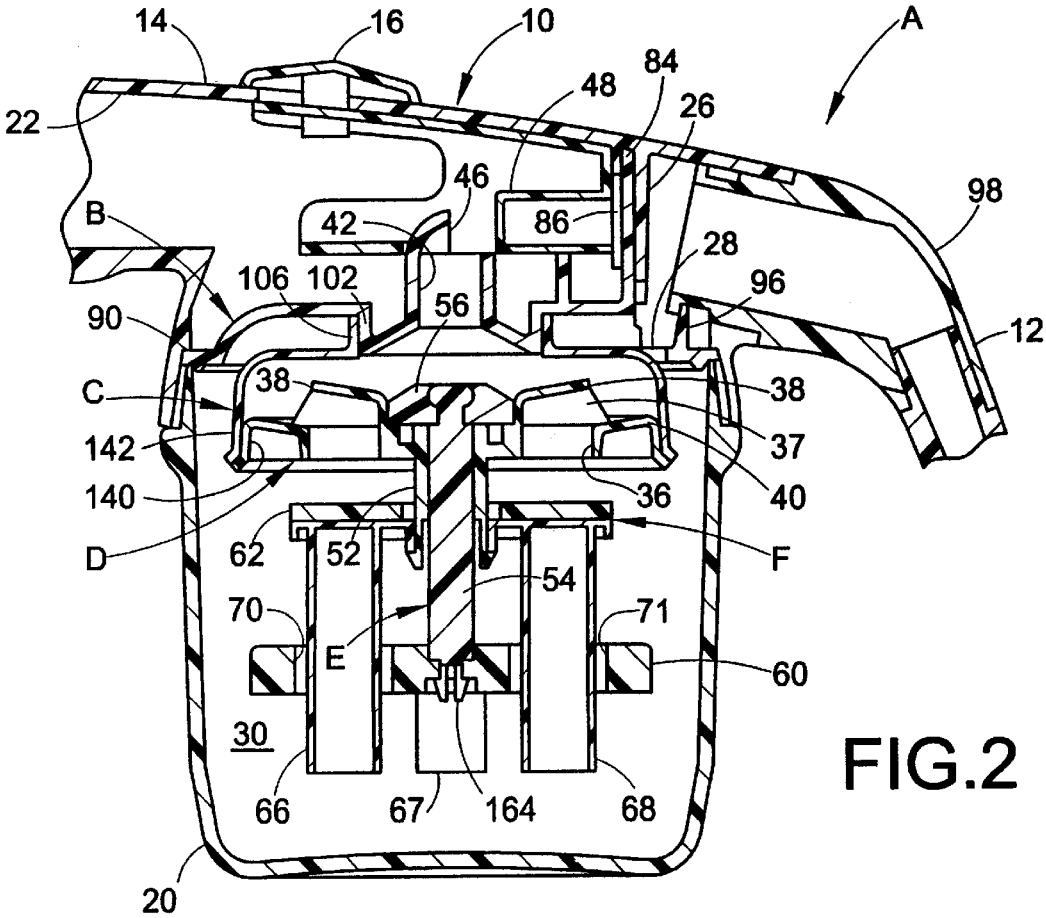
FIG. 2 is a cross-sectional elevational view taken generally on line 2—2 of FIG. 10.
Figure 3:
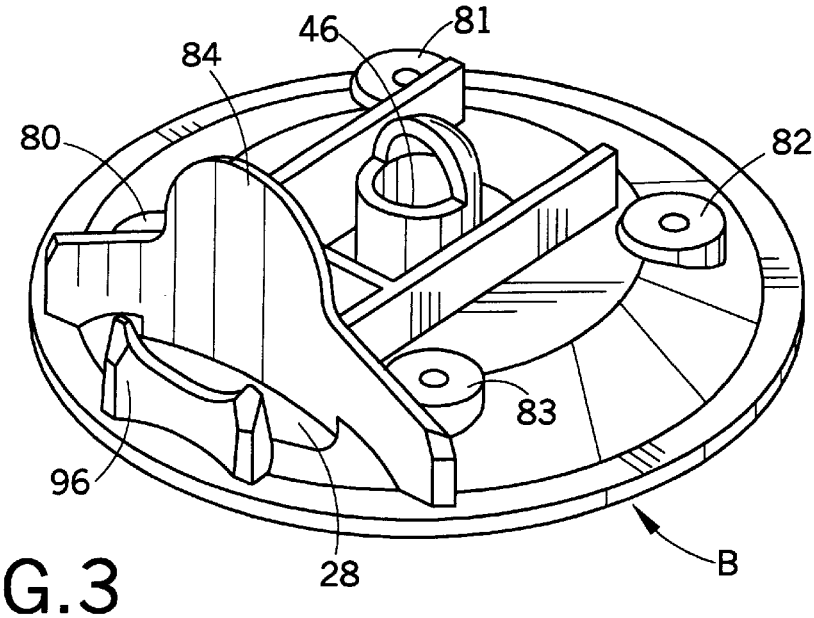
FIG. 3 is a perspective illustration of an internal support member.
Figure 4:
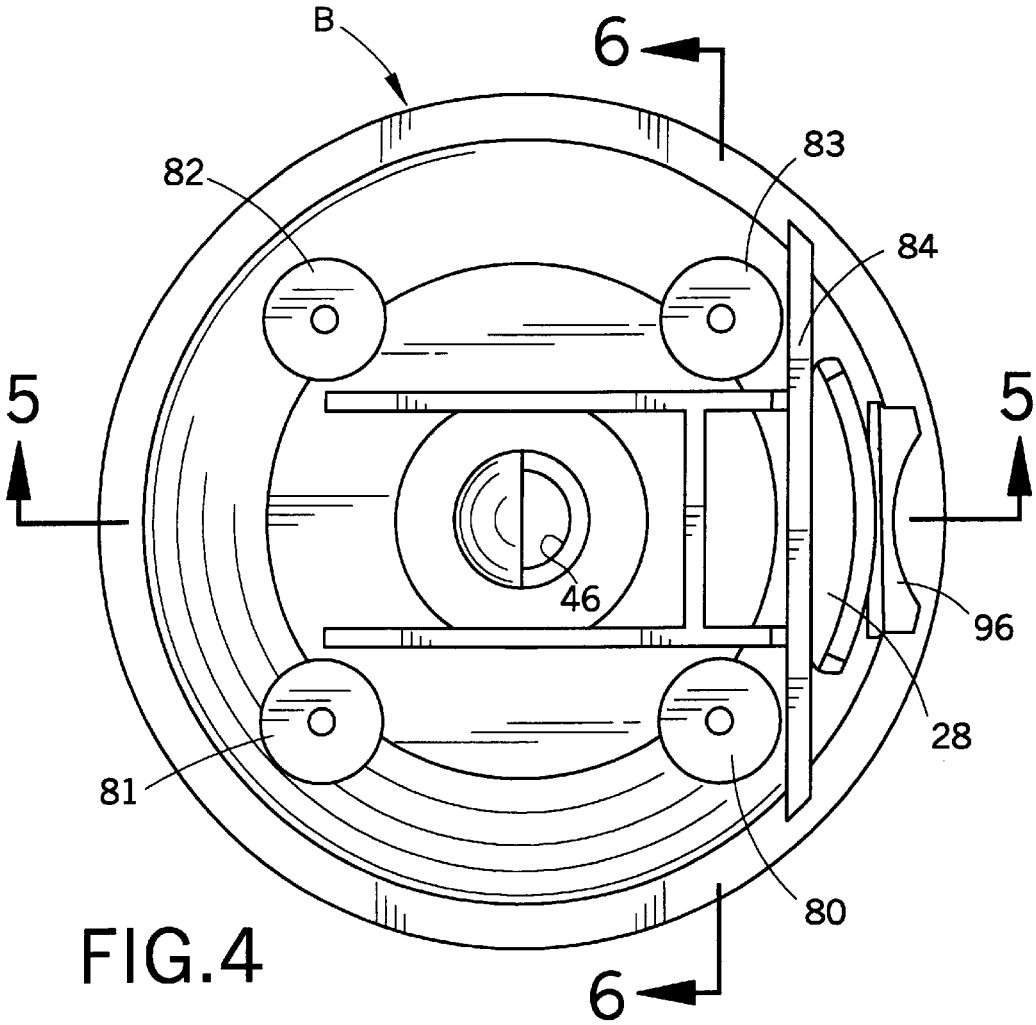
FIG. 4 is a top plan view of the internal support member.

As shown in FIG. 2, tubular handle 14 has an air outlet opening 22 and is attachable to the hose of a conventional vacuum cleaner. Thus, attachment A is connected to the air inlet negative pressure side of the vacuum cleaner fan to provide air flow into nozzle 12 and through attachment A to air outlet opening 22.

Moisture laden air entering nozzle 12 engages a flat surface on baffle 26 within housing member 10 and then travels generally downwardly through an opening 28 in support member B. The moisture laden air then flows against the upper surface of shield member C and downwardly therearound into air/liquid separation chamber 30.

The moisture laden air swirls around within air/liquid separation chamber 30 and then travels upwardly through an annular secondary exhaust opening 36 in valve support member D. The air then travels outwardly through an outwardly facing annular outlet opening 37 between vertically-spaced inner and outer walls 38, 40 on valve support member D. Shield member C then redirects the outward air flow in the opposite direction above annular inner wall 38 toward primary exhaust opening 42. The air then flows upwardly through final outlet opening 46 that is selectively closable by a movable valve member 48 operable by button 16 on housing member 10.

The air exhaust passage from air/liquid separation chamber 30 is through annular secondary exhaust opening 36, outwardly facing annular outlet opening 38, primary exhaust opening 42 and final outlet opening 46 in support member B.

Valve support member D includes a cylindrical central hollow guide sleeve 52 depending therefrom. A primary float operated valve assembly E includes an elongated cylindrical valve stem 54 slidably guided internally of guide sleeve 52. A primary valve member 56 attached to valve stem 54 above valve support member D is provided for selectively closing primary exhaust opening 42. A primary float member 60 of low density polyethylene is attached to the bottom end of primary valve stem 54 below guide sleeve 52.

A secondary float operated valve assembly F includes a secondary valve member 62 in the shape of a disc for selectively closing annular secondary exhaust opening 36. A suitable central hole through secondary valve member 62 loosely receives guide sleeve 52 and provides slidable guiding movement of same externally of guide sleeve 52.

Four downwardly open equidistantly spaced secondary float tubes, only three of which are shown at 66, 67 and 68 in FIG. 2, extend downwardly from secondary float member 62. Primary float member 60 has holes therethrough, only two of which are shown at 70 and 71 in FIG. 2, and the secondary float tubes extend freely through the holes. The holes are substantially larger than the external diameter of the cylindrical float tubes so that there will be no interference with relative vertical movement between the primary and secondary floats.

In operation of the device, handle 14 is attached to the intake of a vacuum cleaner that is turned on. Button 16 is moved forward to move valve member 48 away from opening 46 to allow air flow therethrough and this opens the entire exhaust passage from air/liquid separator chamber 30. Moisture laden air then may enter nozzle 12 and travel into air/liquid separation chamber 30 as previously described. The moisture laden air travels through attachment A in a very tortuous path and engages many surfaces on which the moisture collects as it is separated from the air stream. The liquid gathers in collection tank 20 until it reaches a first liquid level that causes primary float 60 to rise and move primary valve member 56 into position for blocking flow of air through primary exhaust outlet 42.

In the event the primary exhaust outlet remains open, moisture will continue to be separated from the moisture laden air traveling through attachment A until the liquid level in collection tank 20 reaches a second level greater than the first level. The bottom ends of secondary float tubes 66–68 then will be below the liquid level and air trapped within the float tubes makes same buoyant because they are closed at their upper ends. Secondary float operated valve F then will move upwardly to engage secondary valve member 62 with the surfaces around annular secondary exhaust opening 36 for blocking further flow of air therethrough.

Attachment A may be turned off by moving button 16 rearwardly for engaging valve member 48 with the surfaces around final outlet opening 46 to block flow of air therethrough. In that position, valve member 48 is a relatively loose fit within housing member 10 and air may bleed therearound through vent slots 18 of FIG. 1 for flow through handle outlet opening 22 to provide continuous air flow through the vacuum cleaner until it also is turned off.

FIGS. 3–6 show that internal support member B is in the form of a circular disc having bosses 80–83 projecting upwardly therefrom with central screw receiving clearance holes therethrough. A thin flat upwardly extending assembly wall 84 on internal support member B is receivable with an interference fit in a slot between baffle 26 and a rearwardly spaced slot forming wall 86 as shown in FIG. 2. The outer periphery of support member B is received within housing member 10 with an interference fit, and the upper peripheral surface of internal support member B is positioned against a downwardly facing circular shoulder 90 on housing member 10. A suitable adhesive is applied to the peripheral surfaces of internal support member B as well as to flat wall 84 and the slot that it is received in to secure the support within housing member 10.

Opening 28 in internal support member B between flat attachment wall 84 and an upwardly extending projection 96 that is receivable in a suitable circumferential recess in an adaptor 98 that attaches nozzle 12 to housing member 10.

Figure 5:
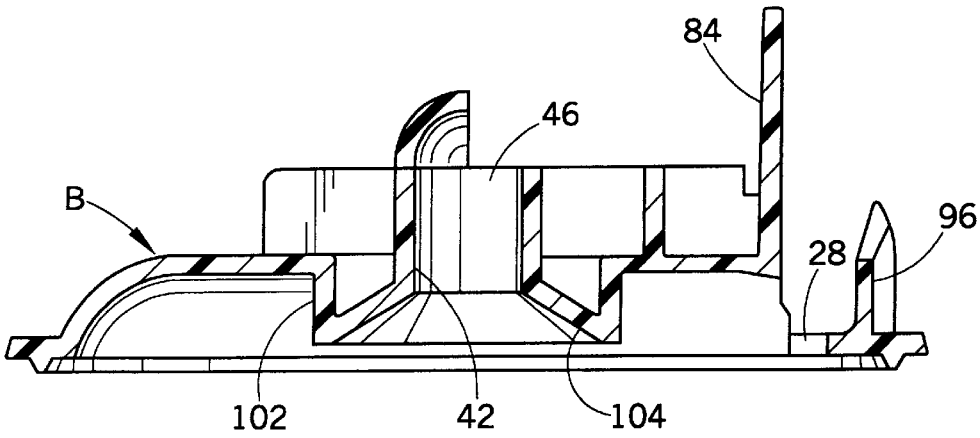
FIG. 5 is a cross-sectional elevational view taken generally on line 5—5 of FIG. 4.
Figure 6:
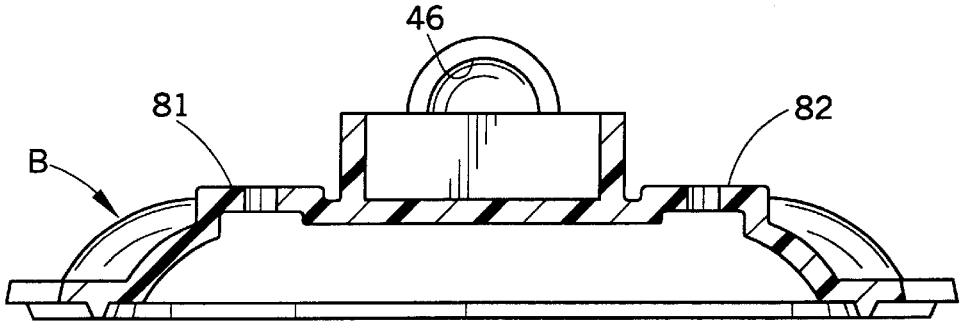
FIG. 6 is a cross-sectional elevational view taken generally on line 6—6 of FIG. 4.

As shown in FIG. 5, internal support member B has a central downwardly extending cylindrical projection 102 thereon surrounding primary exhaust opening 42 which itself is surrounded by an inclined valve seat surface 104. Referring to FIG. 2, shield member C has a central cylindrical projection 106 surrounding a central opening therein and is received with a tight fit on cylindrical projection 102 on internal support member B. A suitable adhesive may be applied to the mating surfaces of the cylindrical projections. Shield member C has the general shape of an inverted cup, and also has a plurality of bosses with screw receiving clearance holes therethrough extending upwardly therefrom. The bosses on shield C and the screw clearance holes therein are aligned with bosses 80–83 and the screw clearance holes therein on internal support member B, and only two of the shield bosses are identified in FIG. 12 by numerals 110 and 112.

Figure 11:
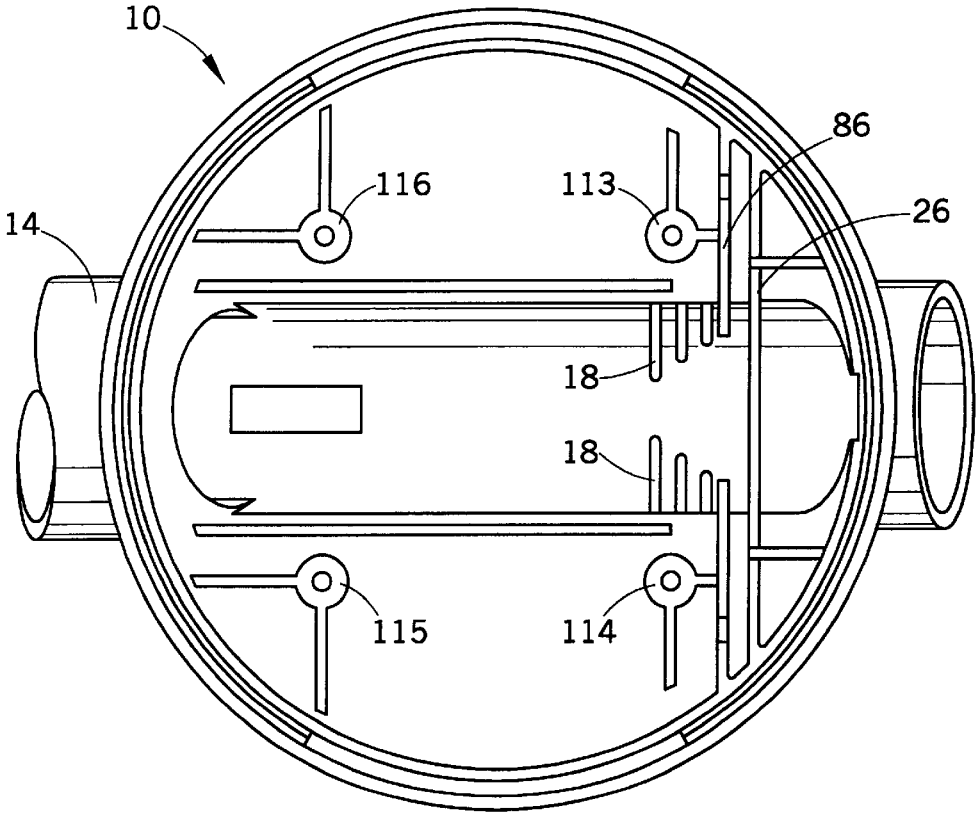
FIG. 11 is a plan view of the interior of the top housing member for the attachment of the present application.

FIG. 11 shows the interior of housing member 10 having bosses 113–116 with bores therein for receiving self-threading screws.

Figure 7:
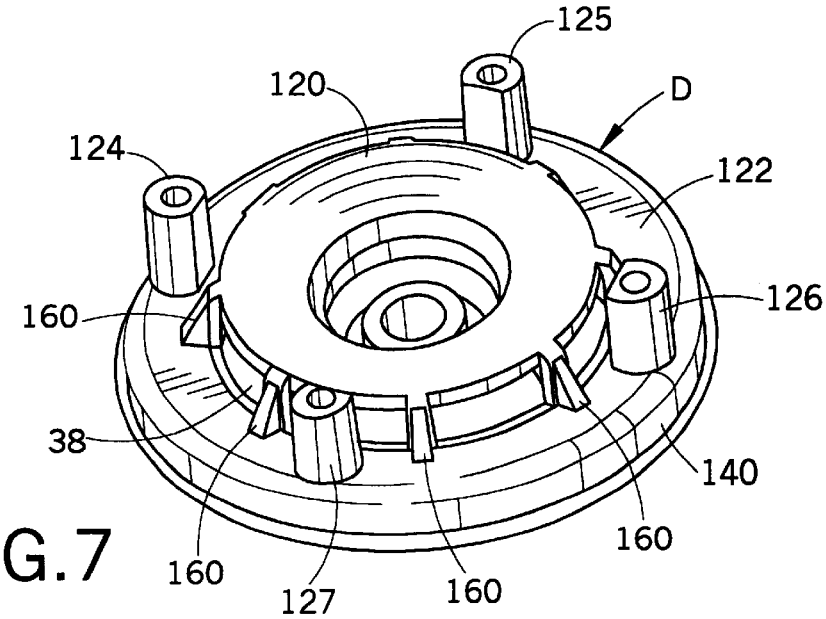
FIG. 7 is a perspective illustration of a valve support member.
Figure 8:
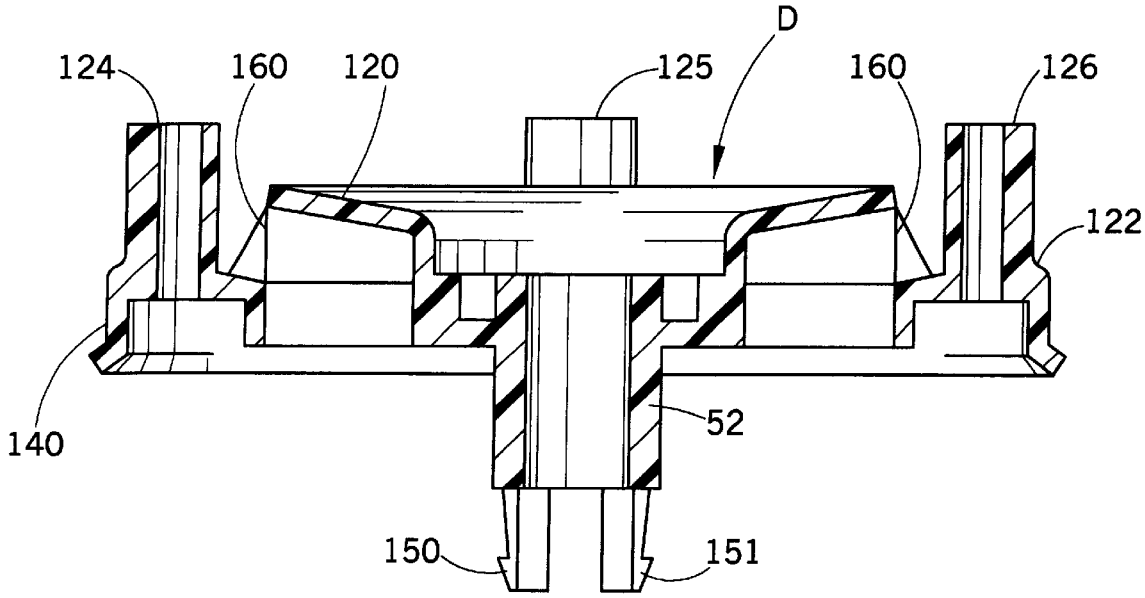
FIG. 8 is a cross-sectional elevational view of the valve support member of FIG. 7.
Figure 9:
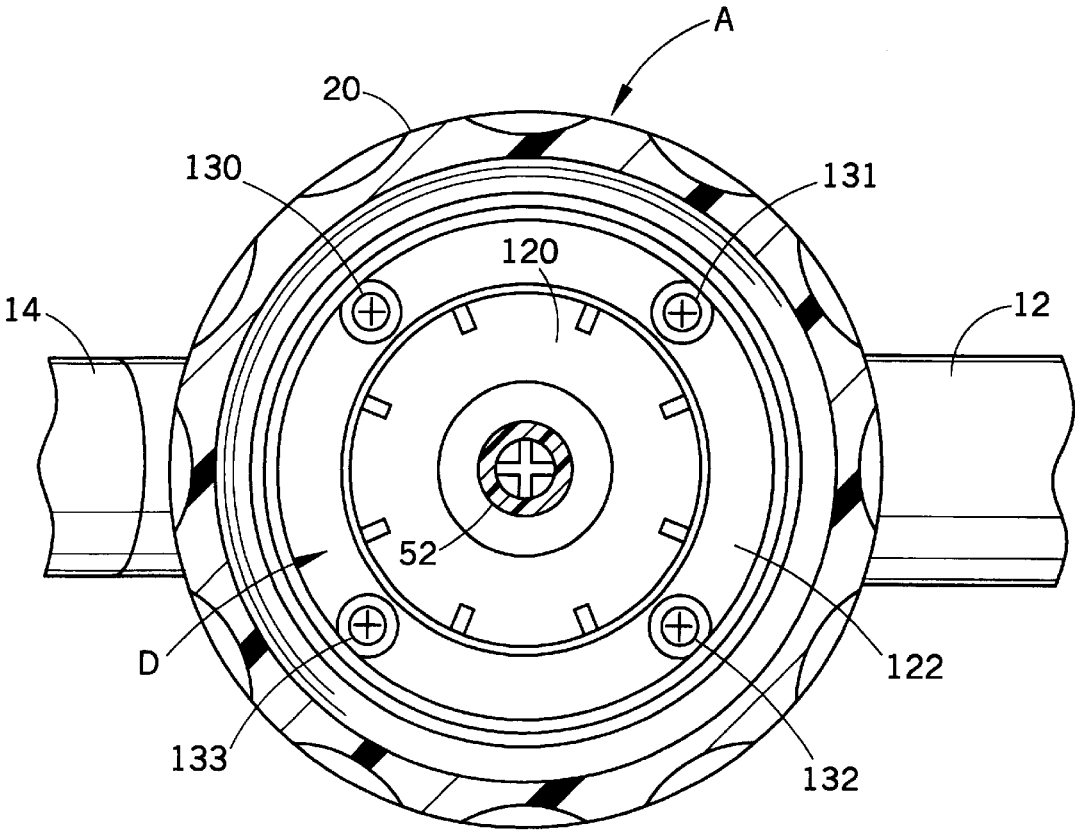
FIG. 9 is a cross-sectional bottom plan view taken generally on line 9—9 of FIG. 1.
Figure 10:
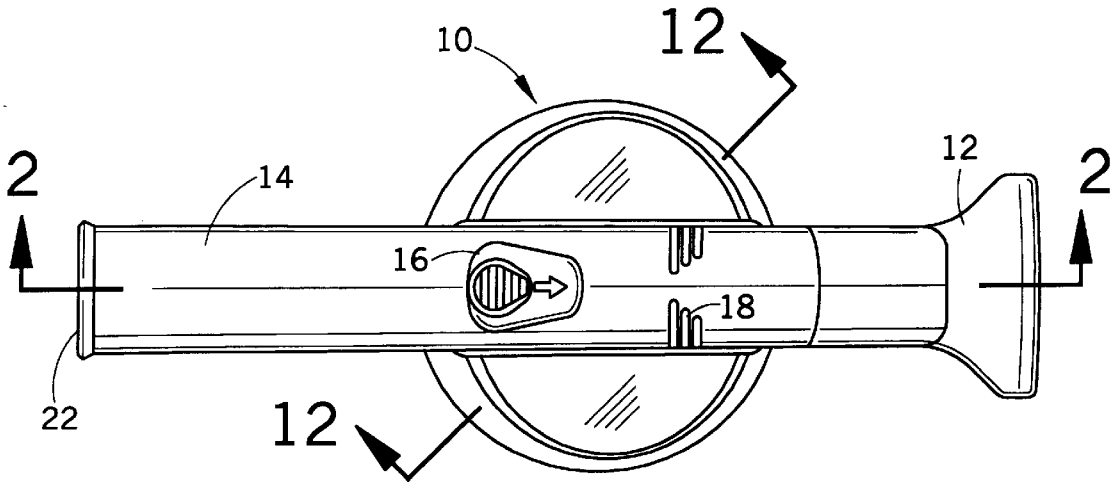
FIG. 10 is a top plan view of the attachment of the present application.
Figure 12:
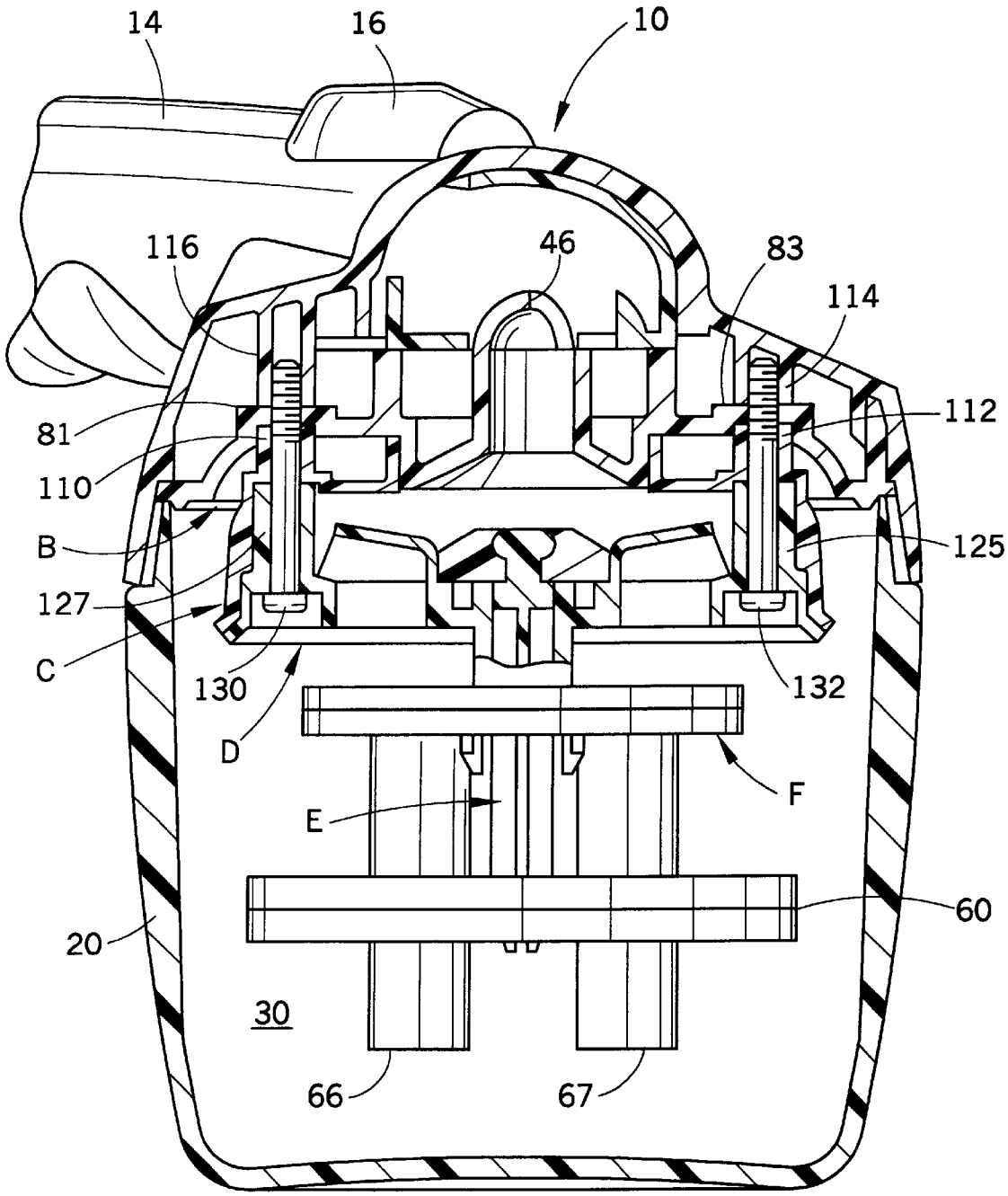
FIG. 12 is a cross-sectional elevational view taken generally on line 12—12 of FIG. 10 to show vertically aligned bosses on a plurality of internal components, the bosses having screw receiving holes therein that are sized such that the screws pass freely through the holes in all of the bosses except the top housing member bosses which has bores into which the screws are self-threading.

Referring to FIGS. 7 and 8, valve support member D has annular vertically spaced inner and outer walls 120, 122 outwardly of hollow guide sleeve 52. Bosses 124–127 extend upwardly from annular outer wall 122 and have screw receiving clearance holes therethrough. Bosses 124–127 and the screw clearance holes therein are aligned with the bosses and screw receiving holes therein on shield member C, and with the bosses and screw clearance holes in internal support member B. Thus, as shown in FIGS. 9 and 12, self-threading screws 130–133 extend freely through the holes in bosses 124–127 in valve support member D, through the holes in the bosses in shield member C, through the holes in bosses 80–83 on internal support member B, and thread into the bores in bosses 113–116 within housing member 10.

Outer wall 122 on valve support member D has a downwardly extending generally cylindrical flange 140 thereon that is received with an interference fit within generally cylindrical peripheral wall 142 of shield member C as shown in FIG. 2.

Guide sleeve 52 has a plurality of circumferentially-spaced downwardly extending outwardly barbed resilient fingers thereon as indicated at 150, 151 in FIG. 8 to prevent displacement of secondary float operated valve F therefrom. Annular inner and outer walls 120, 122 on valve support member D are vertically spaced relative to one another by having the outer periphery of inner wall 120 above the inner periphery of outer wall 122. This provides the outwardly facing annular outlet opening 38 that is circumferentially interrupted by a plurality of circumferentially-spaced molded struts 160 that extend between the outer peripheral portion of inner wall 120 and the inner peripheral portion of annular outer wall 122.

Annular inner and outer walls 120, 122 are parallel to one another and are inclined downwardly about 10° in a direction from their outer peripheries toward their inner peripheries. Thus, the annular inner and outer walls lie on the surfaces of very shallow inverted cones. Outwardly facing opening 38 also is inclined inwardly from its bottom edge toward its top edge so that air flows therethrough at an angle of about 10° above the horizontal.

Outwardly facing circumferential opening 38 is downstream from annular secondary exhaust opening 36 in the direction of air flow from separator chamber 30. Likewise, primary exhaust opening 42 is downstream from openings 36 and 38, and final outlet opening 46 is downstream from primary exhaust opening 42.

The bottom end of primary valve stem 54 has a plurality of circumferentially-spaced resilient barbs 164 thereon that snap through a suitable central hole in primary float 60 to attach the float to the stem.

Although the invention has been shown and described with reference to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A wet pickup vacuum device having an air/water separator with a valved exhaust opening, a valve support member having a central valve guide sleeve depending therefrom, a movable valve member having a valve stem slidably guided by said valve guide sleeve for closing said exhaust opening, annular inner and outer walls surrounding said guide sleeve, said annular inner and outer walls being vertically spaced from one another to provide an outwardly facing annular passage, whereby air flowing upwardly in a direction along said guide sleeve is deflected outwardly through said annular passage to said exhaust opening.

2. A wet pickup vacuum device having an air/water separator with a valved exhaust opening, a valve support member having a central valve guide sleeve depending therefrom, annular inner and outer walls surrounding said guide sleeve, said annular inner and outer walls being vertically spaced from one another to provide an outwardly facing annular passage, whereby air flowing upwardly in a direction along said guide sleeve is deflected outwardly through said annular passage, a primary exhaust opening above said valve support member, a shield member extending between said annular outer wall on said valve support member and said primary exhaust opening, and said shield member providing reversal of the direction of air flowing outwardly through said annular passage by redirecting the air inwardly toward said primary exhaust opening.

3. The device of claim 2 including a secondary exhaust opening in said valve support member between said guide sleeve and said annular outer wall.

4. The device of claim 3 including primary and secondary float operated valves movably guided on said guide sleeve and being operable to close said primary and secondary exhaust openings responsive to the liquid level in said air/liquid separator.

* * * * *